United States Patent [19]

Burger

[11] 4,101,035

[45] Jul. 18, 1978

[54] CONVEYOR BELT SOLIDS SEPARATOR WITH COMBINED SCRAPER AND GAS JET CONTROL

[75] Inventor: Edward D. Burger, Plano, Tex.

[73] Assignee: Atlantic Richfield Company, Los Angeles, Calif.

[21] Appl. No.: 750,072

[22] Filed: Dec. 13, 1976

Related U.S. Application Data

[63] Continuation-in-part of Ser. No. 749,587, Dec. 10, 1976.

[51] Int. Cl.[2] ..... B07C 1/00

[52] U.S. Cl. ..... 209/114

[58] Field of Search ..... 209/114, 117

[56] References Cited

U.S. PATENT DOCUMENTS

| | | | |
|---|---|---|---|
| 661,802 | 11/1900 | Hilleary, Jr. | 209/114 |
| 1,140,236 | 5/1915 | Ayres | 209/117 |
| 1,404,363 | 1/1922 | Grimsrud et al. | 209/114 |
| 2,318,976 | 5/1943 | Stevens | 209/114 |

*Primary Examiner*—Allen N. Knowles

*Attorney, Agent, or Firm*—M. David Folzenlogen

[57] ABSTRACT

Spherically-shaped rolling solids are separated from irregularly-shaped nonrolling solids with an inclined conveyor belt separating system. A dry mixture of the solids is fed onto a section of a continuously upward moving, appropriately inclined conveyor belt. Most of the nonrolling solids eventually move up with the belt and are then moved in a sideways, upward direction or directions off a side of the belt. Most of the rolling solids move down the belt to a preselected area where their movement down and off a side of the conveyor belt is controlled by a combined scraper and gas jet lower control arrangement. The control arrangement has a diagonally placed scraper blade and jets of gas directed longitudinally ahead of the scraper. The control arrangement may also have a side control scraper and side control gas jet. The combined lower control arrangement provides for more efficient utilization of the upper surface area of the conveyor belt while maintaining the desired separation efficiency of the system. This lower control is particularly advantageous for a wide belt divided into two or more distinct separating sections. The initial momentum and direction of movement of the solids feed stream may also be controlled to improve the operation of the solids separating system. The system is especially useful for separating spherical solid heat carriers from spent shale solids in an oil shale retorting facility.

42 Claims, 3 Drawing Figures

CONVEYOR BELT SOLIDS SEPARATOR WITH COMBINED SCRAPER AND GAS JET CONTROL

CROSS REFERENCE TO RELATED APPLICATIONS

This application is a continuation-in-part of Copending Application Ser. No. 749,587, filed Dec. 10, 1976, entitled "Inclined Conveyor Belt Solids Separation System", filed by the same inventor as this invention and owned by a common assignee.

BACKGROUND OF THE INVENTION

This invention pertains to control of the flow of solids onto or off an inclined conveyor belt solids separator wherein lower movement of rolling solids is controlled by a combination scraper and gas jet control arrangement. The separating system is for separating spherically-shaped rolling solids from irregularly-shaped nonrolling solids and is especially useful for oil shale retorting processes using spherically-shaped solid heat carriers which are recycled through the retorting process.

It is sometimes necessary to separate spherically-shaped rolling solids from irregularly-shaped nonrolling solids. This invention relates to an appropriately inclined conveyor belt system for carrying out such separation when a dry, high temperature, compact, high capacity, confined system with controlled atmospheric emissions and with a high degree of adaptability to varying mass flow rates and solids mixtures is required. For example, the retorting of oil shale with spherical solid heat carriers requires that the heat carriers be separated in this manner from spent shale solids. The separation efficiency must be good while carry-over, loss or attrition of the spherically-shaped solids, e.g., heat carriers, is low. It is also desirable that the separating system be relatively compact and have relatively few moving parts in light of the mass of solids to be separated per unit time. It is difficult to achieve these requirements and at the same time maintain the desired separating efficiency of the system.

Copending applications Ser. No. 749,505, filed Dec. 10, 1976, entitled "Separation and Recovery of Heat Carriers in an Oil Shale Retorting Process", and Ser. No. 749,588, filed Dec. 10, 1976, entitled "Inclined Conveyor Belt Solids Separating System with Responsive Gas Control", which are owned by a common assignee and are incorporated herein, cover embodiments of a continuously restored inclined conveyor belt type separating system.

Application Ser. No. 749,587 describes an inclined conveyor belt separating system having upper and lower diagonally placed scraper blades. The upper side of the slanted lower scraper blade acts as downward boundary to movement of spherically-shaped rolling solids and as a divider between distinct separating sections of the belt. More importantly, the lower scraper acts as a control for obtaining the desired separating efficiency level of a separating system operated at reasonably high mass flow rates. The lower scraper deflects the downward moving spherically-shaped solids in a sideways, downward direction off a side of the conveyor belt. This prevents rapid channeling of the rolling solids off the belt and holds a proper amount of rolling solids on the belt. This lower control works in conjunction with the upper control and other feed controls to provide the desired degree of separating efficiency for a minimum length of belt and allows the belt to be divided into the maximum number of distinct separating sections. In a properly tuned or controlled system, the separating efficiency becomes dependent on length and reaches a maximum efficiency at a given length. Below this length, the separating efficiency decreases. Above this length, the separating efficiency is relatively constant. As a result, increasing the length does not increase separating efficiency. Moreover, in a properly controlled, maximum efficiency conveyor belt system, the rate of rolling solids passing through the lower control equals the rate of rolling solids fed onto the belt. Consequently, increasing the length of a belt does not increase the capacity of the system. As a result, there is little to be gained by using a conveyor belt system that is longer than the required length and a number of operating disadvantages arise. The capacity of the conveyor belt system may be greatly increased by dividing the length of the belt into distinct separating sections of the required minimum length, and by increasing the width of the belt. The lower control, that is, the control for the rolling solids, is the most important for obtaining and maintaining the desired maximum separating efficiency for a minimum of belt length. As the width of the belt is increased, the diagonal lower scraper blade control has a problem in moving the spherically-shaped rolling solids sideways and downward off the belt at a rate which is high enough or reactive enough to obtain and maintain the separating efficiency of the minimum required length of the belt. If the rate of removal is increased, channeling of the rolling solids is likely to occur. If the rate of removal is too low, flooding or over saturation of the minimum length of the belt occurs. When operating conditions fluctuate, a wide lower scraper control has difficulty in reacting fast enough to the changed conditions without causing some channeling of the rolling solids which would decrease separating efficiency.

Application Ser. No. 749,588 describes an inclined conveyor belt system with longitudinally directed jets of gas acting as the lower control system. This system has some advantages, but it is not suited to a minimum length, wide separating section, nor is it suited to dividing a belt into multiple separating sections of minimum length each.

In this invention, there is provided a lower control arrangement for an inclined conveyor belt which coactively combines a diagonally located scraper blade, a jet of gas directed diagonally and laterally along the upper side of the scraper blade, jets of gas directed longitudinally ahead or up stream of the scraper blade and diagonally directed jet of gas to increase the capacity of the conveyor belt separating system while maintaining the desired separation efficiency.

SUMMARY OF THE INVENTION

Solids are separated by shape or roll factor on the elongated upper surface of an appropriately inclined conveyor belt. The conveyor belt is inclined from horizontal along its longitudinal axis at an angle which is at least as great as the static roll angle of the spherically-shaped rolling solids and less than the static slide angle of the irregularly-shaped, nonrolling solids. The upper surface of the belt moves upward from the lower end to the upper end of the conveyor belt and provides a continuously restored moving surface for separation of a mixture of solids fed onto the belt.

On the belt, most of the nonrolling solids eventually move up the belt while most of the rolling solids roll down the belt. At two preselected points spaced longitudinally up and down the belt from the feed point, the movement of the solids is controlled. At one of the preselected points which is spaced longitudinally up the belt from the feed point, the upward movement of the nonrolling solids is slowed and the nonrolling solids are moved in a sideways, upward direction or directions to a side of the conveyor belt where the nonrolling solids are removed or fall from the belt. To reduce channeling, a portion of nonrolling solids may be deflected upward toward the center of the belt until they are moved sideways toward the side of the belt.

At the second of the preselected points which is spaced longitudinally downward from the feed point, the downwardly rolling, spherically-shaped solids come under the combined influence of a slanted or diagonally positioned scraper blade which extends across the belt and a row or rows of jets of gas directed longitudinally up the belt or ahead of the scraper blade. Initially, the downward movement of the rolling solids is slowed by the jets of gas which retard downward movement of the solids, loosen or break up bridging of the solids, and partially reduce interaction forces between rolling solids below the gas jets. Below the gas jets, the downward movement of the rolling solids is affected and controlled by the combination of the scraper and jets of gas, but the downward movement is primarily controlled by the diagonal scraper blade and its related side controls. The scraper blade deflects the rolling solids downward and sideways off a side of the belt. The scraper blade also holds rolling solids on the belt and constrains excessive downward movement of the rolling solids through the zone or target area of influence of the jets of gas. Side channeling is reduced by moving a portion of the rolling solids downward toward the center of the belt until they are moved sideways toward the side of the belt. There is also a side jet of gas directed laterally and diagonally across the belt just ahead of the scraper which makes the lower control arrangement more reactive to changes in operating conditions and accelerates the rate of removal of the rolling solids off the belt. This diagonally directed jet is especially suited to wide belts. The lower control arrangement increases the separating efficiency of the belt per unit length and allows the belt width to be increased. It also allows the belt to be divided lengthwise into two or more distinct separating sections. These advantages increase the overall capacity of the belt while maintaining the desired separating efficiency of each section, thereby increasing the overall operating efficiency and compactness of the separating system.

The degree of effectiveness of the system is increased by holding at least two rows of spherically-shaped solids on the belt, and even further by limiting the amount of spherically-shaped solids held on the belt so that the belt is not flooded with solids. The conveyor belt may also be inclined from horizontal by an angle which is at least as great as the static slide angle of a spherically-shaped rolling solid. The initial trapping and channeling tendency of the solids may be reduced by controlling the impact momentum and initial tendency of the solids to move in a predetermined direction on the belt.

DETAILED DESCRIPTION

Figure 1:
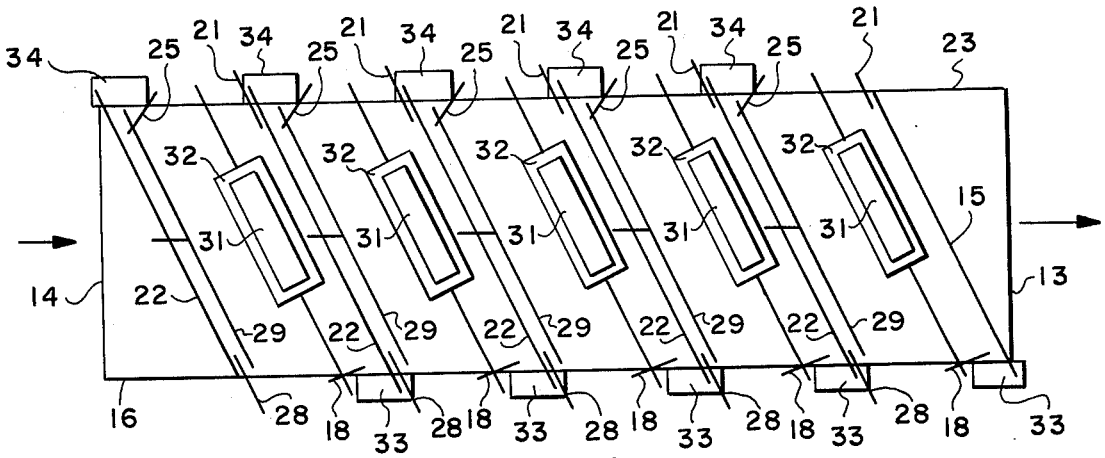
FIG. 1 is a schematical, diagrammatical top plan view of multiple section moving inclined conveyor belt separating system.

As previously noted, this invention relates to an appropriately inclined conveyor belt system for separating solids according to differences in roll factor, that is, by the difference in rate of movement on an inclined surface. The solids may be divided into two groups. One group is sufficiently spherically-shaped to roll down the inclined upper surface of the conveyor belt. Generally, the sphericity factor of the spherically-shaped solids, for the most part, will be at least 0.9, that is, 0.9 or greater. The sphericity factor of these rolling solids is the external or geometric surface area of a sphere having the same volume as the spherically-shaped solid divided by the external surface area of the spherically-shaped solid. The other group of solids is sufficiently irregularly-shaped, laminar-like, flat, or rough, to have one or more sides which tend to cause the irregularly-shaped solid to not roll down the upper inclined surface of the conveyor belt and to come to rest on, or at most, slide down the belt. For purposes of this description, it is assumed that the spherically-shaped solids are the desired solids and that the relative concentration of spherical solids in the mixture is greater than the concentration of irregularly-shaped solids in the mixture.

When a mixture of the two groups of solids is fed onto the inclined upper surface of an upward moving conveyor belt, most of the spherically-shaped solids roll down the inclined belt and most of the irregularly-shaped solids come to rest on the belt and move up with the belt. The belt is inclined from horizontal along its longitudinal axis. The angle is such that it is at least as great as the static roll angle of the desired size spherically-shaped solids and less than the static slide angle of the equal size irregularly-shaped solids. For purposes of this invention, there are three other angles of inclination that should be mentioned. These are the static and dynamic slide angles of the spherically-shaped solids and the dynamic slide angle of the irregularly-shaped solids. These angles are all determined when the conveyor belt is not moving. The static roll angle of the spherically-shaped solids is determined by holding several approximately median size, rolling solids at rest on the conveyor belt at a point on the belt where the solids are to be fed onto the belt, and releasing them to determine the minimum angle at which they will roll down the conveyor belt when released. The static slide angle of the irregularly-shaped solids is determined by holding several irregularly-shaped solids having a size approximately equal to the median size rolling solids at rest on a flat side on the conveyor belt at a point on the belt where the solids are to be fed onto the belt and releasing the irregularly-shaped solids to determine the minimum angle at which they will slide down the conveyor belt when released. The dynamic slide angle of the irregularly-shaped solids is determined by use of the same size nonrolling solids and tapping the solids until they start sliding and determining the minimum angle at which such tapped solids will continue to slide down the surface of the belt. The dynamic slide angle of the irregularly-shaped solids is less than their static slide angle. The static slide angle of spherically-shaped solids is determined by connecting the centers of three median size rolling solids together in an equilateral triangular arrangement with a solid particle at each corner of the triangle. In this manner, there will be three connected spherically-shaped solids tangentially touching the conveyor at only three points. Thereafter, the angle of the belt is adjusted until the minimum angle at which the static connected solids will start to slide and continue to slide down the surface is determined. The dynamic angle of slide of the spherically-shaped solids is determined with the same connected solids and angle adjustment except that the connected three solids are tapped to start them sliding and the minimum angle at which they continue to slide is determined. The static slide angle of the spherically-shaped solids is greater than the dynamic slide angle of the spherically-shaped solids, but is less than the static slide angle of the irregularly-shaped solids. These angles inherently take into consideration the smoothness of the belt and will be determined at normal room temperatures, e.g., 24° C (75° F). Nevertheless, if the system is to be operated at high temperatures, e.g., as encountered in an oil shale retorting process, it is preferred that these angles be measured at the expected operating temperature.

The preferred features of the inclined conveyor belt separating system will now be described in detail by having reference to FIGS. 1 through 3 which show conveyor belt-like member 11 having upper surface 12, upper end 13, and lower end 14. The conveyor belt is taut and uniform. It is made of relatively smooth material and if high separating temperatures are to be present, it will usually be made of stainless steel.

The conveyor belt and its upper surface are inclined from horizontal by angle A which is at least as great as, that is, equal to or larger than, the static roll angle of the spherically-shaped solids to be separated from irregularly-shaped solids when a mixture of the solids is fed onto the belt. The angle of inclination of the belt is less than the static slide angle of the irregularly-shaped solids. These angles have been previously defined. The efficiency and flexibility of the system, especially the rate of movement of the belt, are significantly increased if the angle of inclination A is at least as great as the static slide angle of the spherically-shaped solids.

Upper end 13 is, therefore, at a higher elevation than lower end 14 and the belt is adapted in the usual fashion of a conveyor belt to rotate about its ends. A point on the upper surface of the belt moves upward to and around the upper end of the belt, back downward around the lower end, and back upward to the point of origination. The speed of the belt will be adjusted to suit the other conditions of the separating system including the rate of feed of the solids.

The inclined, upper surface of the belt may be divided into at least two distinct separating sections or areas. As shown, the belt is divided into five sections. Dividing the belt into more than one section enables the belt to handle appreciably more solids per unit surface area.

Figure 2:
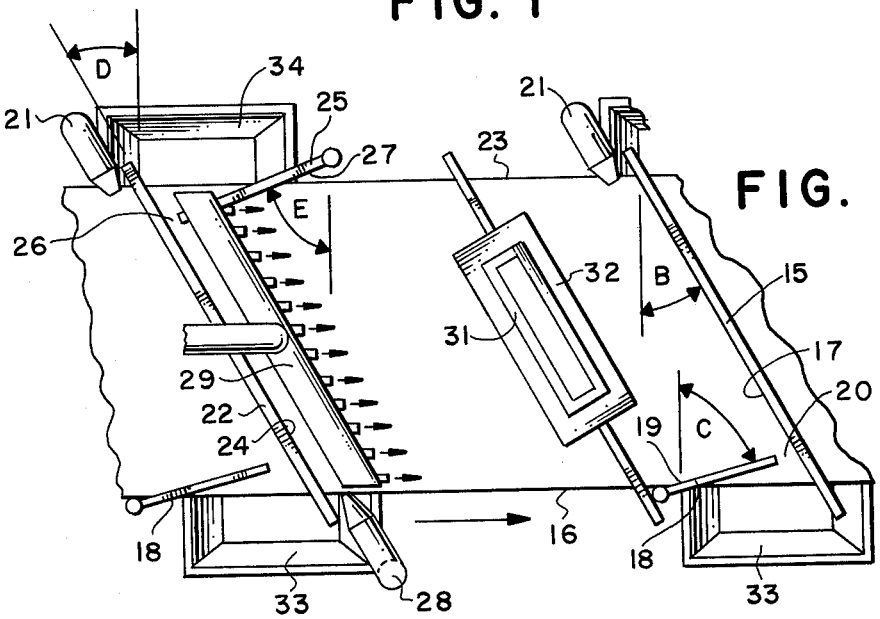
FIG. 2 is a fragmented top plan view of a distinct separating section of the moving inclined conveyor belt separating system.
Figure 3:
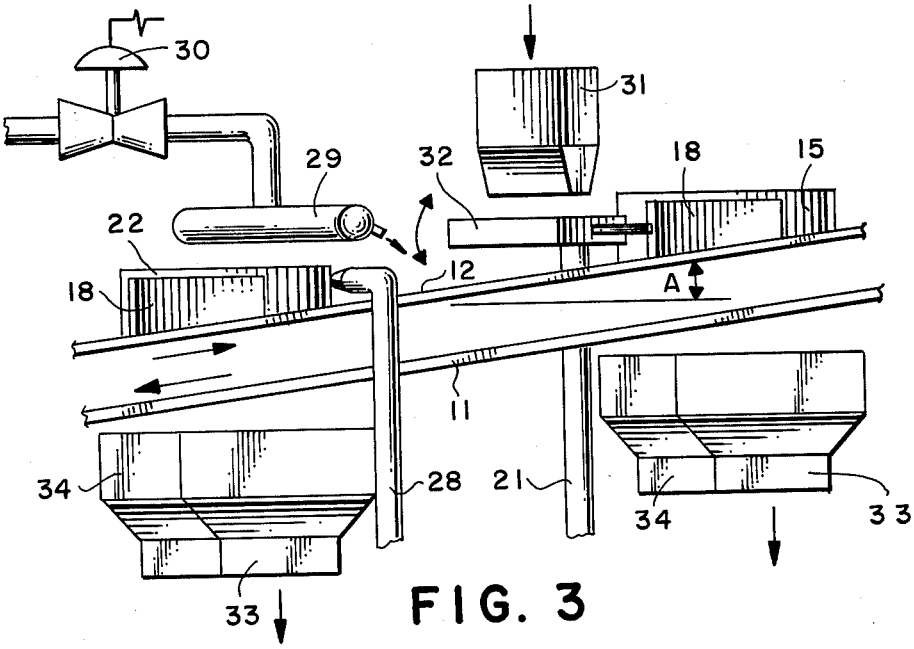
FIG. 3 is a side view of the section of FIG. 2 with a gas control valve added.

Each section of the belt has similar features which are better shown in FIGS. 2 and 3. At a preselected elevation or first removal point or area on the belt, the separating system has upper removal means 15 which is adapted to deflect or move irregularly-shaped nonrolling solids moving upward on upper surface 12 in an upward, sideways direction so that the nonrolling solids move off side 16 of the conveyor belt. Removal means 15 cooperates with movement of the belt and deflects nonrolling solids off the belt. As shown, upper removal means 15 is a scraper blade which has lower side 17 which diagonally crosses upper surface 12 at angle B with respect to the width of the belt so that lower side 17 slopes upward and sideways with respect to the longitudinal axis of the belt. The lower edge of the blade is parallel to and fits flat on upper surface 12. The angle B is appropriately selected to slow and control the rate of upward and sideways movement of the irregularly-shaped solids toward the side of the belt and to cooperate with other sections of the belt and provide the best effective separating surface area per section. The slowing and changing of the direction of movement of the nonrolling solids enables the belt to be divided into two or more distinct separating sections, and tends to free trapped rolling solids and reduce solids channeling off the belt, thereby increasing separation efficiency and reducing loss or carry over of spherically-shaped solids.

The effectiveness of upper removal means 15 is affected by several operating conditions of the separating system especially the degree of solids saturation on the belt. At both high and low saturations, it is best to provide for additional control over the nonrolling solids. Upper side control means 18 is adapted to coact with upper removal means 15 and control the rate of movement of the irregularly-shaped solids deflected toward and off side 16 by the scraper. Upper control means 18 is also adapted to deflect a portion of the irregularly-shaped solids moving upward on upper surface 12 in an upward, sideways direction away from side 16 of the conveyor belt and toward lower side 17 of upper removal means 15. As shown, side control means 18 is a scraper which has inner side 19. The control scraper is pivotally and adjustably mounted to control opening 20 between lower side 17 and the end of the control means and to change angle C with respect to the width of the belt. This upper control means could be operated manually or automatically and appropriate sensors could be provided for detecting rate of solids movement, saturation and buildup near the first removal point.

If conditions warrant, upper side gas jet control means 21 of this side gas jet control means would be adapted to increase the rate of movement of the irregularly-shaped solids through opening 20 and off side 16 of the conveyor belt. The side gas jet control means is an appropriately aimed gas jet which could be controlled manually or automatically by appropriate sensors. The jet of gas emitted by this side control means is directed generally ahead of and parallel to lower side 17 of upper removal means 15.

At a second preselected removal point or area on upper surface 12 which point is spaced along the longitudinal axis of conveyor belt-like member 11 away from and at an elevation below upper removal means 15 is lower removal means 22. The lower removal means is adapted to deflect or move spherically-shaped rolling solids moving downward on upper surface 12 in a downward, sideways direction so that the rolling solids move off side 23 of the conveyor belt. Lower removal means 22 also cooperates with other elements of the belt as hereinafter described. The lower removal means is a scraper blade which has upper side 24 which diagonally crosses upper surface 12 at angle D with respect to the width of the conveyor belt so that upper side 24 slopes downward and sideways with respect to the longitudinal axis of the conveyor belt-like member and deflects spherically-shaped solids in a downward, sideways direction. The lower edge of the scraper blade is parallel to and fits flat on upper surface 12. The angle D is appropriately selected to control the rate of downward and sideways movement of the spherically-shaped solids.

Associated with lower removal means 22 is lower side control means 25 which is adapted to coact with the lower removal means and control the rate of movement of the spherically-shaped solids deflected or moved off the conveyor belt by the lower removal means. As shown, lower side control means 25 is a scraper which is pivotally and adjustably mounted to control opening 26 between upper side 24 of lower removal means 22 and the end of the lower side control means and to change angle E with respect to the width of the belt. The lower side control means could be operated manually or automatically and appropriate sensors would be provided for detecting rate of solids movement, saturation, and buildup near the second removal point. Side control means 25 has inner side 27 which is adapted to deflect a portion of the spherically-shaped solids moving down the belt in a downward, sideways direction away from side 23 of the conveyor belt and toward upper side 24 of the lower removal means.

Associated with lower control means 22 is side gas jet control means 28 which is adapted to increase the rate of movement of spherically-shaped solids through opening 26 and off side 23 of conveyor belt 11. The side gas jet control means is an appropriately aimed gas jet which could be controlled manually or automatically by appropriate sensors in the same way that lower side control means 25 is controlled or the hereinafter described, longitudinally directed gas jet control means is controlled. The jet of gas emitted by this side control means is directed generally ahead of and parallel to upper side 24 of lower removal means 22.

Longitudinally directed gas control means 29 operates in conjunction with lower removal means 22 and its related side controls. The gas control means is adapted to emit jets of gas directed angularly and longitudinally to a preselected target area on inclined surface 12 and extending over a major portion of the width of the upper surface of the belt ahead of upper side 24 of lower removal means 22. The gas control means is shown as a cylinder extending diagonally across and generally parallel to the scraper blade of lower removal means 22 and is shown as having a row or rows of nozzles or holes for emitting jets of gas up the belt. The cylinder is located in any position relative to the scraper blade that allows the jets of gas to be properly directed against downward moving spherically-shaped rolling solids in the preselected target area. The desired action of the jets will be hereinafter discussed. For illustrative and clarity purposes, the cylinder is shown as being ahead of the scraper blade and above inclined surface 12 by a suitable distance. The number and location of jet or blow holes will be selected to provide jets of gas of sufficient force and area to hold up movement of a predetermined amount of rolling solids on the belt and coact with lower removal means 22 and its related side controls. The force and action of the jets of gas emitting from longitudinal gas control means 29 will be controlled both manually and automatically by way of appropriate sensors which detect rate of rolling solids movement, saturation or buildup in and above the preselected target area. The sensors transmit appropriate control signals to suitable control means 30 so that the force of the jets varies in response to changes in operating conditions or solids movement or buildup. In other words, the coaction of the jets of gas and lower removal means 22 will be adapted to hold a preselected minimum amount of rolling solids in the target area and varied to prevent oversaturation or flooding of the separating surface area of a section of the belt. Preferably, the lower control system will be adapted to maintain at least two rows of spherically-shaped solids in the target area. The gas jet forces will also lessen the interaction between the solids and facilitate release of trapped irregularly-shaped nonrolling solids.

For reasons hereinafter made apparent, the jets of gas are directed to a target area that is a preselected distance ahead of the scraper. This distance is sufficiently ahead of lower removal means 22 or up the belt from the lower scraper blade to leave a path or area between the scraper blade and target area through which rolling solids may roll downward and sideways off the belt and through which side gas jet control means 28 may accelerate the rate of movement of rolling solids adjacent upper side 24 of the lower scraper blade. This path or area is outside the target area of the jets of gas and provides an area through which a row or a preselected number of rows of rolling solids may move before the solids adjacent the upper side of the scraper blade affect the rate of movement of rolling solids exiting the target area of jets of gas. Preferably, the jets will also be directed in a manner such that the imaginary lower boundary of the target area is parallel to upper side 24 of the lower scraper blade. This preserves separating surface area and increases the compactness and surface area utilization of the system.

The belt area lying between upper removal means 15 and lower removal means 22 provides sufficient surface area for separation of a mixture of solids according to roll factor at a preselected mass flow rate. The distance and surface area between the two removal means will be selected to provide the minimum distance necessary to effect the maximum separating efficiency so that the overall capacity and compactness of the system may be maximized.

At a preselected point between the two removal means is supply means 31 which is located above a portion of upper surface 12 and is adapted to feed a mixture of spherically-shaped solids and irregularly-shaped solids onto a moving impingement area portion of upper surface 12. Supply means 31 is any sort of system, e.g., one or more chutes or passages, for feeding a mixture of solids onto upper surface 12. Preferably, supply means 31 will be adapted to feed solids in a way such that the effective separating surface distances between the feed system and each removal means will be preserved. In other words, the supply means will distribute solids in a pattern that is parallel to the lower removal means. Moving solids have momentum and tend to initially move up or down the upper surface of the conveyor belt. This tends to reduce the effective separating surface area of the belt and to cause one group of solids to initially trap solids from the other group. The extent of these problems may be reduced by adapting the supply means to reduce the impact momentum of the solids on upper surface 12 and by further adapting the supply means to control the initial tendency of the solids to move in a predetermined direction on upper surface 12. The predetermined direction will depend on the angle of inclination of the conveyor belt, the rate of movement of upper surface 12, the solids feed rate, the relative concentrations of the solids, and the solids saturation on upper surface 12. The objective is to minimize trapping of other solids and increase separating efficiency. As illustrated, the supply means has pivotal deflector plate 32 which slows the rate of movement of the solids just prior to their impacting upper surface 12 of the conveyor belt. The deflector plate is pivoted to provide the proper angle and direction of feed of the mixture of solids to at least partially control the initial tendency of the impacting solids to move in the desired direction.

At each removal point, there is means for receiving solids falling off a side of the conveyor belt. As shown, first receiving means 33 is adapted to receive irregularly-shaped solids deflected off side 16 of conveyor belt-like member 11 by upper removal means 15. Second receiving means 34 is adapted to receive spherically-shaped solids deflected off side 23 of the conveyor belt by lower removal means 22. The receiving means are any sort of system, e.g., one or more troughs, catchers, or chutes, for receiving and collecting solids.

As previously mentioned, the overall efficiency and compactness of the conveyor belt separating system is enhanced if upper surface 12 of the conveyor belt-like member is divided along its longitudinal axis into two or more distinct separating sections with a first removal means at the upper end of each section and a second removal means at the lower end of each section. There will also be a supply means for each section and receiving means for the separated solids.

The features described above for each section are especially suited to multiple section conveyor belt separating system. Moreover, as shown, each section may be separated by a removal means which has an upper side and a lower side. Contiguous sections will lie in progressively higher elevations up the belt. The upper side of a removal means may act as the lower removal means for deflecting spherically-shaped solids from the belt. The lower side of a removal means may act as the upper removal means for deflecting irregularly-shaped solids from the belt.

In the drawing, it is also to be noted that upper removal means 15 moves irregularly-shaped solids toward side 16 and that lower removal means 22 moves spherically-shaped solids toward side 23. Actually, the pair of removal means could be made to move their respective solids toward the same side of the conveyor belt, but it is much preferred that removal means move their respective solids toward opposite sides of the belt, especially if the belt is divided into two or more distinct separating areas. This would save space on the belt and facilitate collection of each group of solids through a common receiving system and reduce the number of pieces of equipment that would need to be fabricated.

During operation, upper surface 12 of the conveyor belt is inclined from horizontal at an angle at least as great as the static roll angle of the spherically-shaped solids, and more preferably at least as great as the static slide angle of the spherically-shaped solids, and at an angle which is less than the static slide angle of the irregularly-shaped solids, and more preferably, less than the dynamic slide angle of these nonrolling solids. The upper surface is moved continuously upward around upper end 13 and downward and around lower end 14 past one or more feed points at supply means 29. This movement provides a continuously restored impingement area for receipt of solids. The impingement area will be clean of solids except for previously trapped solids moving up or down on the belt after being freed.

A mixture of spherically-shaped solids and irregularly-shaped solids is fed at one or more supply or feed points onto one or more initial impingement areas of upper surface 12. Preferably, the impingement areas will be diagonally oriented and parallel to lower removal means 22. The rate of movement of the solids being fed onto the inclined surface of the belt may be slowed just prior to impact with the surface, thereby reducing the impact momentum that the solids would have had had they not been slowed. Moreover, the direction of movement of the solids may be adjusted by deflector plate 32 to control the initial tendency of the solids to move up or down the conveyor belt or to essentially have no initial tendency to move in either direction. Reducing impact momentum and controlling initial movement of the solids will increase the separating efficiency per unit length and reduce the trapping of solids of the other class.

The angle of inclination of the belt and the rate of feed of the mixture of solids maintain a monolayer of spherically-shaped solids on upper surface 12. The word "monolayer" refers to a single layer of rolling solids with respect to vertical or an axis perpendicular to upper surface 12. In other words, the solids do not stack one on top of the other. A monolayer is necessary to proper operation of an inclined conveyor belt separation system of the type described herein because it is assumed that the relative concentrations of the rolling solids is equal to or greater than the concentration of the nonrolling solids. At these relative concentrations, a relatively large percentage of the irregularly-shaped solids will be trapped by the spherically-shaped solids and move down the belt until the rate of downward movement of the solids is decreased or the irregularly-shaped solids come to rest. In order to move back up with the belt, the irregularly-shaped solids must grab the upper surface 12. If the solids were not maintained in a monolayer, the irregularly-shaped solids could not grab the upper surface of the conveyor belt.

After the mixture impacts the upper surface of the belt, the spherically-shaped solids are allowed to roll down upper surface 12. Since the relative concentration of the spherically-shaped solids is relatively high, most of the spherically-shaped solids will rapidly roll down the belt. Some spherically-shaped solids may be trapped by upwardly moving irregularly-shaped solids. These trapped rolling solids will be mentioned again.

Jets of gas will be emitted from longitudinally directed gas control means 29 against a target area on moving upper surface 12. Preferably, the jets of gas will form a target area that extends diagonally across the belt and extends parallel to lower removal means 22.

The spherically-shaped solids rolling down the belt will normally trap some irregularly-shaped solids. At a preselected point or area of the conveyor belt, downward moving solids come under the influence of longitudinally directed gas control means 29 either by entering the target area of the jets of gas emitting from the longitudinal gas control means or by contacting other solids which are being held up in the target area. In other words, in the target area, the jets of gas slow the downward speed of the spherically-shaped solids and loosen or break up bridging and particle interaction of the rolling solids. This causes the trapped irregularly-shaped nonrolling solids to come to rest on upper inclined surface 12 and allows these nonrolling solids to grab the belt. These freed or resting trapped nonrolling solids migrate upward with upper surface 12 because the particle bridging or interaction has been changed or disrupted, because the angle of inclination of the conveyor belt is less than the static slide angle, and preferably less than the dynamic slide angle, of the nonrolling solids, because these is less channeling of spherically-shaped solids off the conveyor belt, and because there is less interaction and chances of interaction between a resting solid moving up the belt than there was initially when the mixture was fed onto the conveyor belt.

The force and other effects of the jets of gas are adjusted to hold a predetermined amount of solids in the target area. When properly timed, the desired amount of solids will be held up in the target area and the rate of rolling solids leaving the lower boundary of the target area will equal the average rate of arrival of rolling solids into the target area. For purposes of describing the operation of the lower multiple control arrangement, the target area may be considered as having a predetermined number of side-by-side rows of rolling solids slowly moving downward through the target area and previously trapped nonrolling solids moving back up the belt from the target area. When a rolling solid arrives at the upper edge of the target area, a rolling solid in the last or bottom row of solids at the lower boundary of the target area is projected into the open path between upper side 24 of lower removal means 22 and the target area. The force and other effects of the jets of gas are varied by suitable means, e.g., control means 30, to hold the proper amount of solids in the target area and to prevent flooding or over saturation of the separating surface area of the belt between the solids in the target area and the feed impingement area. Enough rolling solids are held in the target area to facilitate release of bridged or trapped irregularly-shaped nonrolling solids. Preferably, at least two side-by-side rows of spherically-shaped solids are held in the target area. If the rolling solids leave the target area at too fast a rate, some trapped irregularly-shaped solids may be carried through the target area. The rolling solids would then contact lower removal means 22 where the irregularly-shaped solids would have a further chance of being separated, but the likelihood of carryover would be increased. If the rolling solids do not leave the target area at a fast enough rate, a wave of unseparated solids moves up the belt flooding or over saturating the separating area and greatly reducing separating efficiency.

The rolling solids leaving the target area roll downward against upper side 24 or against a rolling solid already in the open path area. In the path area, lower removal means 22 causes the spherically-shaped solids to move in a downward, sideways direction at an angle with respect to the longitudinal axis of the conveyor belt so that the spherically-shaped solids move to a side of the conveyor belt where they are removed from the belt. The lower removal means creates several effects which increase the separation efficiency per unit length of the belt and overall separation efficiency per unit width of the belt. The lower removal means allows the belt to be divided into two or more distinct separating sections. The lower removal means provides a control of over rapid channeling of rolling solids off the belt after the rolling solids have exited the target area of the jets of gas. This provides for freeing of irregularly-shaped nonrolling solids that were accidentally projected into the open path area. The lower removal means normally controls and retards rate of movement of the nonrolling solids off the belt. The rolling solids held up in the open path area act as a limit on surge amounts of rolling solids that could be rapidly projected from the target area. For example, if a sporadic surge in feed rate or relative concentration of rolling solids in the feed occurred, a surge in arrival of rolling solids into the target area would occur. The sensors of longitudinal gas control means 29 could react to this surge, but the surge could also cause particle interactions which would project an undesirable, excessive amount of rolling solids into the open path carrying trapped nonrolling solids into this path. But lower removal means 22 limits the amount of rolling solids that could be quickly projected into the open path. The solids would build up against upper side 24 and thus limit the rows or amount of solids that could be rapidly projected out of the target area. If the sporadic surge were of long enough duration, the longitudinal gas control means would react to prevent build up and flooding of solids and side gas jet control means 28 would accelerate movement of rolling solids in the open path area off the belt to allow the proper balance of solids movement through the target area to be maintained. The sideways, downward movement of solids caused by lower removal means 22 provides a flow path that takes up less belt length than a straight downward path would require yet the lower removal means provides a flow path that is long enough to allow freeing and compensating actions to occur.

The lower removal means provides for controlling the rate of rolling solids movement off the belt and of balancing relative flow distances of rolling solids over the width of the belt. This prevents excessive channeling of solids off one side of the belt and aids in the other effects previously described. Lower side control means 25 is involved in these latter results. It controls the exit opening for the open path between the scraper blade of lower removal means 22 and the gas target area of longitudinal gas control means 29 and also deflects a portion of the rolling solids near exit side 26 of the belt in a downward, sideways direction away from the side of the conveyor belt toward the center of the belt before these solids are moved by lower removal means 22 off the side of the coneyor belt.

The foregoing description shows how the multiple element lower control arrangement, which is the most important control in the overall system, releases most of the trapped irregularly-shaped solids to move upward with the belt and most of these nonrolling solids eventually wind up moving up the belt to one or more upper removal points or areas.

At the upper removal point, the direction of upward movement of the irregularly-shaped solids is changed by upper removal means 15 and these nonrolling solids are moved upward and sideways at an angle with respect to the longitudinal axis of the conveyor belt so that the irregularly-shaped solids move toward the side of the conveyor belt where they are removed from the belt. This allows the belt to be divided into distinct separating sections and allows trapped spherically-shaped solids to roll free and move down the belt, thereby reducing carry-over of the desired spherically-shaped solids.

Channeling and the rate of movement of the irregularly-shaped nonrolling solids off the conveyor belt is controlled by the coaction of upper removal means 15 and upper side control means 18. The upper side control means controls the exit opening between it and the scraper blade of the upper removal means and deflects the upward movement of a portion of the irregularly-shaped solids in an upward, sideways direction away from side 16 of the conveyor belt before this portion of the solids is moved upward and sideways by upper removal means 18. This further increases the probability that trapped rolling solids, if any, will be released and prevents surge losses of unseparated solids.

The volumes and relative amounts and sizes of the solids in the mixture will affect the overall design of the separating system. The spherically-shaped solids are normally in a relatively narrow size range when compared to the irregularly-shaped solids. The inclined conveyor belt system is especially suited to spherically-shaped solids in having a size above 0.14 centimeter (0.055 inch). The separating system performs best when a significant portion or all of the larger size and smaller size irregularly-shaped solids, especially fine size solids, are removed prior to using the inclined conveyor belt separating system. Fortunately, it is usually relatively easy to separate and remove a significant portion of the irregularly-shaped or fine size undesired solids.

If there is an appreciable amount of irregularly-shaped solids which are larger than the spherically-shaped solids and the volumes to be handled justify it, it would be best to first process the mixture to separate at least a portion of the larger irregularly-shaped solids prior to using the inclined conveyor belt system. The larger size irregularly-shaped solids may be separated by screening. This initial screening or separation of the larger size solids is optional and this step may be delayed until after some of the smaller size irregularly-shaped solids are removed.

By the same token, if the amount of irregularly-shaped solids smaller than the spherically-shaped solids is sufficiently large to warrant it, it would be best to remove at least a portion of the finer irregularly-shaped solids prior to treating the mixture of the inclined surface. Fine size solids greatly affect rolling characteristics and tend to unduly adhere to the separating surface of the conveyor belt. A significant portion, especially fines, of the smaller size irregularly-shaped solids may be removed by screening or by a low velocity elutriating gas. If the system is to be operated at elevated temperatures, it will be desirable to heat the gas used in elutriation. The gas should be a noncombustion supporting gas if there are combustible materials present on the solids.

The separating system of this invention is particularly advantageous for separating spherically-shaped heat carriers from irregularly-shaped spent shale, especially porous pellet heat carriers in a size range of between 0.14 centimeter (0.055 inch) to approximately 1.27 centimeter (0.5 inch) of the type described in U.S. Pat. No. 3,844,929. In oil shale retorting, mined crushed oil shale is mixed with hot, heat-carrying, spherically-shaped solids in a retort. The heat in the hot heat carriers pyrolyzes oil and gas vapors from the oil shale and produces a mixture of spherically-shaped solids and nonrolling spent shale. After retorting, the solids mixture is processed to recover the heat carriers for recycle through the retorting process and for separation and disposal of the spent shale. This separation and recovery of solids is usually accomplished in several stages. One of the separating stages will use the inclined conveyor belt system of this invention. As mentioned in Copending application Ser. No. 749,505, the efficiency of this prcess will be increased if a portion of the irregularly-shaped spent shale solids larger than the heat carriers is removed and if a portion of the irregularly-shaped spent shale solids smaller than the heat carriers is removed prior to processing a mixture of the remaining solids on the inclined conveyor belt system of this invention.

Several preferred embodiments of various features of the invention have been described and illustrated. It is to be understood that the invention is not to be limited to the precise details or features herein illustrated and described since these features and excellent results may be obtained and carried out in a number of other ways falling within the scope of the invention as illustrated and described.

The embodiments of the invention in which an exclusive property or privilege is claimed are defined as follows:

1. A system for separating spherically-shaped solids which tend to roll down an inclined surface from irregularly-shaped solids which tend to slide down an inclined surface comprising:

a. a conveyor belt-like member having an upper surface, an upper end and a lower end and adapted to rotate about said upper end and said lower end in a manner such that a point on said conveyor belt-like member cycles upward around said upper end, downward around said lower end, and then upward to the point of origination, said upper surface of said conveyor belt-like member being inclined from horizontal along its longitudinal axis at an angle at least as great as the static roll angle of the spherically-shaped solids and less than the static slide angle of the irregularly-shaped solids;

b. upper removal means adapted to deflect irregularly-shaped solids moving upward on said upper surface in an upward, sideways direction so that said irregularly-shaped solids move off a side of said conveyor belt-like member;

c. first receiving means adapted to receive irregularly-shaped solids deflected off said inclined conveyor belt-like member by said upper removal means;

d. lower removal means spaced along the longitudinal axis of said conveyor belt-like member from and below said upper removal means, said lower removal means having an upper side adapted to deflect spherically-shaped solids moving downward on said upper surface in a downward, sideways direction so that said spherically-shaped solids move off a side of said conveyor belt-like member;

e. second receiving means adapted to receive spherically-shaped solids deflected off said inclined conveyor belt-like member by said second removal means;

f. longitudinal gas control means adapted to emit jets of gas directed angularly and longitudinally to a target area extending over a major portion of the width of said upper surface, said target area being upward and ahead of said upper side of said lower removal means by a preselected distance, said preselected distance being such that at least one row of spherically-shaped solids adjacent said upper side of said lower removal means is outside said target area of said jets of gas, said jets of gas being of sufficient force to affect the downward movement of spherically-shaped solids in said target area on said upper surface; and g. supply means adapted to feed a mixture of said spherically-shaped solids and said irregularly-shaped solids onto a portion of said upper surface between said upper removal means and said target area of said longitudinal gas control means.

2. The system of claim 1 wherein the supply means is adapted to reduce the impact momentum of the spherically-shaped solids and the irregularly-shaped solids on the upper surface of the conveyor belt-like member.

3. The system of claim 1 wherein the upper surface of the conveyor belt-like member is inclined from horizontal along its longitudinal axis at an angle which is at least as great as the static slide angle of said spherically-shaped solids and is less than the static slide angle of said irregularly-shaped solids.

4. The system of claim 1 wherein upper side control means is adapted to deflect a portion of the irregularly-shaped solids moving upward on the upper surface in an upward, sideways direction away from a side of the conveyor belt-like member toward the upper removal means.

5. The system of claim 4 wherein the supply means is adapted to reduce the impact momentum of the spherically-shaped solids and the irregularly-shaped solids on said upper surface of said conveyor belt-like member.

6. The system of claim 4 wherein said upper surface of said conveyor belt-like member is inclined from horizontal along its longitudinal axis at an angle which is at least as great as the static slide angle of the spherically-shaped solids and is less than the static slide angle of said irregularly-shaped solids.

7. The system of claim 4 wherein the lower removal means and the longitudinal gas control means are adapted to maintain at least two rows of spherically-shaped solids in the target area of said upper surface.

8. The system of claim 1 wherein lower side control means is adapted to deflect a portion of the spherically-shaped solids moving downward on the upper surface in a downward, sideways direction away from a side of said conveyor belt-like member toward the lower removal means.

9. The system of claim 8 wherein upper side control means is adapted to deflect a portion of the irregularly-shaped solids moving upward on said upper surface in an upward, sideways direction away from a side of said conveyor belt-like member toward the upper removal means.

10. The system of claim 8 wherein the supply means is adapted to reduce the impact momentum of the spherically-shaped solids and the irregularly-shaped solids on said upper surface of said conveyor belt-like member.

11. The system of claim 8 wherein said upper surface of said conveyor belt-like member is inclined from horizontal along its longitudinal axis at an angle which is at least as great as the static slide angle of said spherically-shaped solids and is less than the static slide angle of the irregularly-shaped solids.

12. The system of claim 8 wherein said lower removal means and the longitudinal gas control means are adapted to maintain at least two rows of said spherically-shaped solids in the target area of said upper surface.

13. The system of claim 1 wherein side gas jet control means is adapted to increase the rate of movement of the spherically-shaped solids adjacent the lower removal means off the conveyor belt-like member.

14. The system of claim 13 wherein lower side control means is adapted to deflect a portion of the spherically-shaped solids moving downward on the upper surface in a downward, sideways direction away from a side of said conveyor belt-like member toward said lower removal means.

15. The system of claim 14 wherein said lower removal means and the longitudinal gas control means are adapted to maintain at least two rows of said spherically-shaped solids in the target area of said upper surface.

16. The system of claim 14 wherein said upper surface of said conveyor belt-like member is divided along its longitudinal axis into at least two sections, an upper removal means at the upper end of each of said sections, a lower removal means at the lower end of each of said sections, a longitudinal gas control means associated with each of said lower removal means, and supply means adapted to feed a mixture of said spherically-shaped solids and said irregularly-shaped solids onto a portion of said upper surface within each of said sections between said upper and said lower removal means.

17. The system of claim 14 wherein said upper surface of said conveyor belt-like member is inclined from horizontal along its longitudinal axis at an angle which is at least as great as the static slide angle of said spherically-shaped solids and is less than the static slide angle of said irregularly-shaped solids.

18. The system of claim 14 wherein the supply means is adapted to reduce the impact momentum of said spherically-shaped solids and the irregularly-shaped solids on said upper surface of said conveyor belt-like member.

19. The system of claim 14 wherein upper side control means is adapted to deflect a portion of the irregularly-shaped solids moving upward on said upper surface in an upward, sideways direction away from a side of said conveyor belt-like member toward the upper removal means.

20. The system of claim 19 wherein the supply means is adapted to reduce the impact momentum of said spherically-shaped solids and said irregularly-shaped solids on said upper surface of said conveyor belt-like member.

21. The system of claim 19 wherein said upper surface of said conveyor belt-like member is inclined from horizontal along its longitudinal axis at an angle which is at least as great as the static slide angle of said spherically-shaped solids and is less than the static slide angle of said irregularly-shaped solids.

22. The system of claim 19 wherein said lower removal means and the longitudinal gas control means are adapted to maintain at least two rows of said spherically-shaped solids in the target area of said upper surface.

23. The system of claim 19 wherein said upper surface of said conveyor belt-like member is divided along its longitudinal axis into at least two sections, an upper removal means at the upper end of each of said sections, a lower removal means at the lower end of each of said sections, a longitudinal gas control means associated with each of said lower removal means, and supply means adapted to feed a mixture of the spherically-shaped solids and the irregularly-shaped solids onto a portion of said upper surface within each of said sections between said upper and said lower removal means.

24. The system of claim 13 wherein upper side control means is adapted to deflect a portion of the irregularly-shaped solids moving upward on said upper surface in an upward, sideways direction away from a side of said conveyor belt-like member toward the upper removal means.

25. The system of claim 24 wherein the supply means is adapted to reduce the impact momentum of said spherically-shaped solids and said irregularly-shaped solids on said upper surface of said conveyor belt-like member.

26. The system of claim 24 wherein said lower removal means and the longitudinal gas control means are adapted to maintain at least two rows of said spherically-shaped solids in the target area of said upper surface.

27. The system of claim 24 wherein said upper surface of said conveyor belt-like member is divided along its longitudinal axis into at least two sections, an upper removal means at the upper end of each of said sections, a lower removal means at the lower end of each of said sections, a longitudinal gas control means associated with each of said lower removal means, and supply means adapted to feed a mixture of said spherically-shaped solids and said irregularly-shaped solids onto a portion of said upper surface within each of said sections between said upper and said lower removal means.

28. The system of claim 24 wherein said upper surface of said conveyor belt-like member is inclined from horizontal along its longitudinal axis at an angle which is at least as great as the static slide angle of said spherically-shaped solids and is less than the static slide angle of said irregularly-shaped solids.

29. A method for separating spherically-shaped solids which tend to roll down an inclined surface from irregularly-shaped solids which tend to slide down an inclined surface comprising:

a. moving an inclined upper surface of an elongated conveyor belt around a lower end of said conveyor belt at a lower elevation past at least one feed point to a higher elevation around an upper end of said conveyor belt, said movement from said lower elevation to said higher elevation being inclined at an angle with respect to horizontal, said angle being at least as great as the static roll angle of said spherically-shaped solids and being below the static slide angle of said irregularly-shaped solids;

b. feeding a mixture of spherically-shaped solids and irregularly-shaped solids at a first feed point onto an initial first impingement area of said upper surface, said first impingement area being constantly changed and restored as said upper surface is moved from said lower elevation past said first feed point to said upper elevation;

c. moving most of said irregularly-shaped solids fed onto said upper surface in a generally longitudinal direction up said upper surface to a first removal point at an elevation higher on said conveyor belt than said first impingement area;

d. changing the direction of upward movement of the irregularly-shaped solids at said first removal point and moving the irregularly-shaped solids at said first removal point in an upward, sideways direction at an angle with respect to the longitudinal axis of said conveyor belt so that said irregularly-shaped solids move toward a side of said conveyor belt;

e. allowing most of said spherically-shaped solids fed onto said upper surface to roll down said upper surface to a target area which is at an elevation above a second removal point on said conveyor belt and lower than said first impingement area; the rate of feed of said mixture in step (b) and said angle in step (a) being such that a monolayer of solids with respect to vertical is maintained on said upper inclined surface at said second removal point;

f. emitting jets of gas into said target area and slowing the downward speed of the spherically-shaped solids at said target area;

g. allowing spherically-shaped solids passing through said target area to roll downward to said second removal point;

h. changing the direction of downward movement of the spherically-shaped solids at said second removal point and moving said spherically-shaped solids at said second removal point in a downward, sideways direction at an angle with respect to the longitudinal axis of said conveyor belt so that said spherically-shaped solids move to a side of said conveyor belt; and i. removing spherically-shaped solids at said second removal point off the side of said conveyor belt.

30. The method according to claim 29 wherein the angle of inclination from horizontal of the upper surface of the conveyor belt is at least as great as the static slide angle of the spherically-shaped solids and is less than the static slide angle of the irregularly-shaped solids.

31. The method according to claim 29 wherein the rate of movement of the solids being fed onto the upper surface in step (b) is slowed prior to impact with said upper surface, thereby reducing the impact momentum that said solids would have had without having been slowed.

32. The method according to claim 29 wherein steps (b) through (i) inclusive, are conducted at at least two separate sections on the conveyor belt.

33. The method according to claim 29 wherein the direction of upward movement of a portion of the irregularly-shaped solids at the first removal point is changed and said portion of said irregularly-shaped solids is moved in an upward, sideways direction away from the side of the conveyor belt before said portion of said irregularly-shaped solids is moved in step (d) off said side of said conveyor belt.

34. The method according to claim 29 wherein at least two rows of the spherically-shaped solids are held in the target area of the upper surface.

35. The method according to claim 29 wherein the rate of removal of the spherically-shaped solids off the side of the conveyor belt at the second removal point is increased whenever the buildup of spherically-shaped solids at said second removal point indicates that said buildup is likely to interfere with separating efficiency of said method.

36. The method according to claim 29 wherein a portion of the spherically-shaped solids moving down the conveyor belt is moved at the second removal point in a downward, sideways direction away from the side of the conveyor belt before said portion of said spherically-shaped solids is moved in step (h) off said side of said conveyor belt.

37. The method according to claim 36 wherein the angle of inclination from horizontal of the upper surface of said conveyor belt is at least as great as the static slide angle of said spherically-shaped solids and is less than the static slide angle of the irregularly-shaped solids.

38. The method according to claim 36 wherein the rate of movement of the solids being fed onto the upper surface in step (b) is slowed prior to impact with said upper surface, thereby reducing the impact momentum that said solids would have had without having been slowed.

39. The method according to claim 36 wherein steps (b) through (i), inclusive, are conducted at at least two separate sections on said conveyor belt.

40. The method according to claim 36 wherein the direction of upward movement of a portion of the irregularly-shaped solids at the first removal point is changed and said portion of said irregularly-shaped solids is moved in an upward, sideways direction away from the side of said conveyor belt before said portion of said irregularly-shaped solids is moved in step (d) off said side of said conveyor belt.

41. The method according to claim 36 wherein at least two rows of said spherically-shaped solids are held in the target area of the upper surface.

42. The method according to claim 36 wherein the rate of removal of said spherically-shaped solids off said side of said conveyor belt at said second removal point is increased whenever the buildup of spherically-shaped solids at said second removal point indicates that said buildup is likely to interfere with separating efficiency of said method.

* * * * *